United States Patent [19]

Gagnon

[11] Patent Number: 4,884,371

[45] Date of Patent: Dec. 5, 1989

[54] CORNER CONNECTOR FOR SLIDING DOORS

[75] Inventor: Laurent Gagnon, Thornhill, Canada

[73] Assignee: DSH, Concord, Canada

[21] Appl. No.: 306,091

[22] Filed: Feb. 3, 1989

[51] Int. Cl.[4] ..... E06B 3/00

[52] U.S. Cl. ..... 49/501; 49/409; 16/105

[58] Field of Search ..... 49/501, 412, 409, 411; 52/630, 805, 825, 823, 821, 291; 248/220.1; 16/105

[56] References Cited

U.S. PATENT DOCUMENTS

| | | | |
|---|---|---|---|
| 3,058,173 | 10/1962 | Brydolf | 49/411 |
| 3,744,827 | 7/1973 | Cox | 49/411 |
| 3,879,912 | 4/1975 | Cox | 49/409 |
| 4,023,326 | 5/1977 | Azuma et al. | 49/501 |
| 4,288,887 | 9/1981 | Johnson et al. | 49/409 |
| 4,391,019 | 7/1983 | Downes | 16/105 |

*Primary Examiner*—Kenneth J. Dorner
*Assistant Examiner*—Gerald A. Anderson
*Attorney, Agent, or Firm*—Ridout & Maybee

[57] ABSTRACT

Corner connector brackets, for connecting rails and stiles applied to a panel to form a sliding door, and for supporting arms carrying rollers or guides for the door, have snap in connections to the rails and stiles to be connected, and are positively retained in engagement with the corner of the panel, in a manner resistant to torsional forces about a vertical axis, so as to maintain correct alignment of the rollers or guides.

11 Claims, 2 Drawing Sheets

CORNER CONNECTOR FOR SLIDING DOORS

BACKGROUND OF THE INVENTION

This invention relates to corner connectors for use in sliding door assemblies.

In a widely used form of sliding door used for closets and other fairly light-duty applications, the door is formed by a relatively thin panel of hardboard or similar material, with a suitable decorative facing, or by a mirror, to the edges of which are applied metallic stiles and rails linked by top and bottom corner connectors which also support and guide the door for sliding movement along top and bottom tracks fixed in a door opening. The top connectors have upwardly projecting arms carrying rollers which suspend the door from the upper rail, whilst the bottom connectors have downwardly projecting arms terminating in guide members or rollers which engage the lower rail and maintain the door in the desired plane whilst accommodating some degree of irregularity in the vertical spacing of the top and bottom tracks.

Progressively improved versions of such corner connectors are described in detail in U.S. Pat. No. 3,058,173 (Brydolf), and Canadian Pat. Nos. 844,876 (Kellems) and 978,805 (Brydolf et al). The structure of the Kellems patent not only links the stiles and rails, but also draws them together during assembly and largely eliminates the need for screws, rivets or other separate fastenings to secure the parts together. It requires however a different connector of each corner of the panel, and is relatively expensive to manufacture. The Brydolf et al Canadian patent discloses a connector which, whilst having somewhat less rigid interlocking with the stiles than the Kellems patent, and requiring a different form of stile, is cheaper to manufacture, and can be used on either side of a panel.

U.S. Pat. No. 4,391,019 (Downes) discloses a corner connector bracket which permits the suspension arms or guides to be detachable, so that the same bracket can be used at both the top and the bottom of a panel, whilst U.S. Pat. No. 3,744,827 (Cox) discloses corner connectors using a bracket which is reversible end to end. A modification of the Cox connector, available commercially, is also bilaterally symmetrical. Although this connector makes multipoint contact with the panel, it is only restrained at the stile against movement away from the panel; its resistance to torsional movement is thus dependent on the torsional stiffness of the stile, which is relatively low.

All of these various corner connector arrangements hold together the stiles and rails at the corners of a sliding door with varying but generally adequate degrees of effectiveness, although in some cases requiring stiles of specific section. A further requirement of such corner connectors is that they maintain the arms carrying the rollers or guides for the door in correct alignment relative to the door panel. This is important for maintaining free running of the door, and is a requirement which in general has not been fully met by existing designs because the flexibility of the rail and stile profiles needed to provide for different panel thicknesses results in inadequate resistance to torsional movement of the brackets and thus the arms.

One arrangement which overcomes this problem is the Leigh Snap-Fit Door, described in a brochure issued under that title by Leigh Products Inc. of Coopersville, Mich. This door assembly relies upon corner brackets adhesively secured to the panel, the stiles and rails being snap fitted to the corner brackets. In this arrangement, the rails and stiles are not positively locked together into a perimeter frame, and take little part sustaining the weight of the door and operating forces, which are largely borne through the adhesive bonds by the corners of the panel. The arrangement of the Brydolf U.S. Pat. No. 3,058,173 also overcomes the problem, but relies upon the use of now obsolete stile and rail sections, and requires to be screwed and staked in place.

SUMMARY OF THE INVENTION

The present invention seeks to provide a corner connector arrangement for sliding door panels which combines easy assembly, positive interlocking with the rails and stiles, improved resistance to misalignment, the ability to use the same corner connector bracket at opposite sides of a door, and compatibility with stiles of the sections widely used with currently available corner connectors.

According to the invention, there is provided a corner connector bracket for connecting a rail and a stile at the corner of a panel of a sliding door, the rail and stile each having channels to engage the panel, comprising a body defining a generally channel shaped vertically extending and rearwardly facing recess having a forward wall and side walls, means for locating in the recess a vertically extending arm having a guide element supported at a distal end thereof, a first land at one vertical end of said front wall, said land being engageable with said rail at a rear side thereof, a first forwardly extending flange at said one vertical end of said forward wall, a distal end of the flange being inturned to form a tongue extending vertically towards the other end of the body, said first tongue being engageable in a slot formed in a horizontal surface of said rail and forwardly of the channel therein, second flanges extending forwardly from each side of said forward wall at locations spaced from said one vertical end, distal ends of said second flanges being out-turned to form second lands engageable with the rear surface of the panel, and barbed second tongues extending laterally outwards from said side walls at locations thereon spaced from said one vertical end and to the rear of said second flanges, one of said tongues being lockable into a slot defined in the stile.

Preferably each side wall is also provided with abutment surfaces engageable with a stile adjacent thereto when the land of the second flange on that side is within the channel of the stile.

With this arrangement, the bracket is not only securely interlocked when in use with the stile and the rail, but is also positively located in relation to the panel by the engagement of the second lands with the panel, and the double engagement of the first tongue and the first land with the rail. Nevertheless, the slots in the stile and rail which receive the tongues can be formed in the same position as those used for example with the connector of Canadian Pat. No. 978,805 or other widely used corner connector systems.

Advantageously, the second lands can also be formed with barbs on their rear surfaces to assist in retaining them in the channel of a stile. Advantageously also, the second tongues may be formed with plural barbs at different lateral spacings so as to accommodate stiles of different sections.

The invention is described further with reference to the annexed drawings.

BRIEF DESCRIPTION OF THE DRAWINGS In the drawings:

FIG. 1 is a fragmentary isometric view illustrating a connector bracket in accordance with the invention engaged with a rail, a stile and a panel at the corner of a sliding door.

FIG. 2 an isometric view of the corner connector bracket used in FIG. 1;

FIG. 3 an enlarged sectional detail showing parts of the bracket and the panel in engagement with a stile of different cross-section; and FIG. 4 an isometric view of a modified form of bracket for use with a bottom roll assembly having an arm of enlarged width.

DESCRIPTION OF THE PREFERRED EMBODIMENTS

Figure 1:
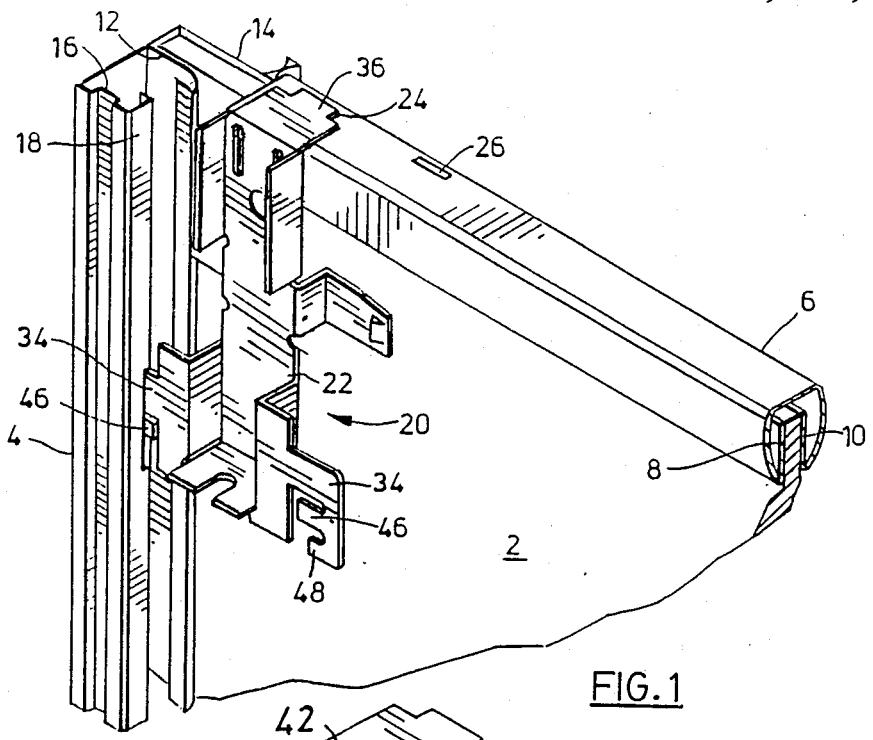

Referring to FIG. 1, there is shown from the rear one corner of a sliding door incorporating the connector of the present invention. A panel 2, which may be of hardboard or plywood with a decorative outer surface layer or veneer laminated thereto, or a mirror, is fitted at its side edges with stiles 4 and at its top and bottom edges with rails 6. The stiles and rails are conventionally roll formed from sheet steel, both for economy and because such a construction provides a flexible cross-section which can be configured to provide channels which resiliently grip the edges of panels of a range of thicknesses. The cross-sectional configurations of the stile and rail shown in FIG. 1 are both well known and have been used in such doors for a number of years. The rail 6 is of U-section, with the arms of the U inturned to provide flanges 8 and 10 gripping the edge of the panel 2. The stile is approximately of E section, with a central arm 12 of the section biased to grip an edge of the panel between itself and a front arm 14, whilst the free edge of a rear arm 16 is wrapped inwardly to provide an inward facing surface 18 which can be slotted as at 22 to receive a tongue 34 of a corner connector bracket 20. An outward surface of the rail is also slotted at 24 and 26, with the slot 24 receiving a tongue 36 of the corner connector bracket.

Thus far the construction is conventional, but the corner connectór bracket 20 itself (see FIGS. 2–4) differs from those customarily used in that it is braced by the rail and stile against the panel to which the rail and stile are applied, thus restraining the bracket against torsional forces tending to move the general plane of the bracket out of parallelism with the panel, and inhibiting rattling. The bracket is stamped from sheet steel, and has a body defining a generally channel shaped, vertically extending and rearwardly facing recess, defined by a forward wall 22, side flanges 24 and 26 respectively, and an end flange 28. The wall 22 is formed with a hole 30 to receive a rivet (not shown) which retains an arm (not shown), an end of which arm projects from the channel at the opposite end from the flange 28 and carries a roller or guide. The construction and attachment of such arms is well understood in the art, and illustrated in the prior patents to which reference has been made above. A slot 32 in the flange 28 locates an adjusting screw projecting from the arm in a manner well known in the art and also illustrated in the prior patents. The flanges 24 and 26 and the wall 22 guide the arm and maintain it in alignment with the general plane of the bracket.

As described further below with reference to FIG. 4, the rivet hole 30 may be replaced by a struck out tongue which locates the arm in the manner disclosed in the Downes patent.

In order to maintain the general plane of the bracket in alignment with the panel 2, the former is provided, between the pairs of rearwardly extending flanges 24 and 26, with a pair of forwardly extending flanges 38, the distal ends of which are out-turned so as to form widely laterally spaced lands 40 which lie flat against the back of the panel 2. The end of the wall 22 which carries the tongue 36 is also stepped forwardly or dimpled to form a land or lands 42 which rests against the back of the rail, whilst the tongue 36 passes through the slot 24 and rests against the flange 10, thus bracing the latter against the panel 2. One of the lands 40 passes beneath the arm 12 of the stile, and is retained under it by a barb 44 struck rearwardly from the land. It will thus be understood that two of the three lands 40 and 42 are secured positively in relation to the panel against either forward or rearward movement, without substantial reliance on the rigidity of the stile and rail sections, whilst the third is restrained against forward movement. This arrangement provides substantial resistance to movement or misalignment of the bracket about a vertical axis, such as will in turn result in misalignment between a roller or guide supported by the bracket and a rail or guide to be traversed by the door of which the bracket forms part. It also inhibits rattling of the bracket resulting from loose engagement of the latter with the stile and rail, since the bracket, like the stile and rail, is held in frictional engagement with the panel.

Figure 2:
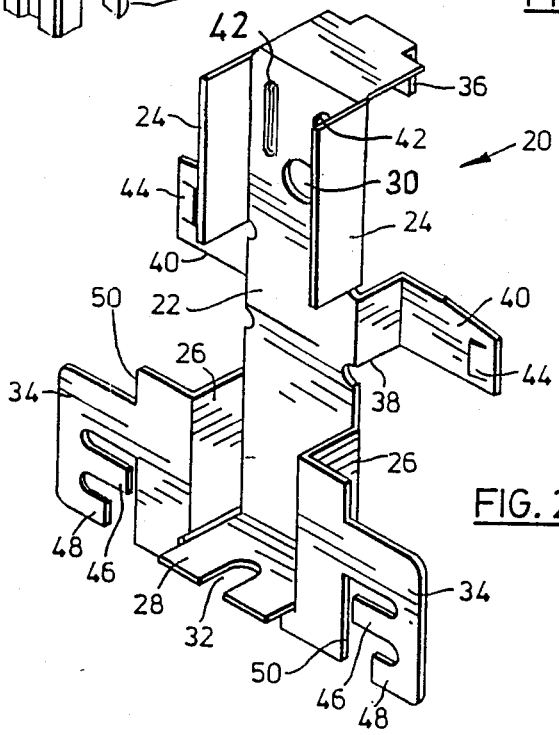
Figure 3:
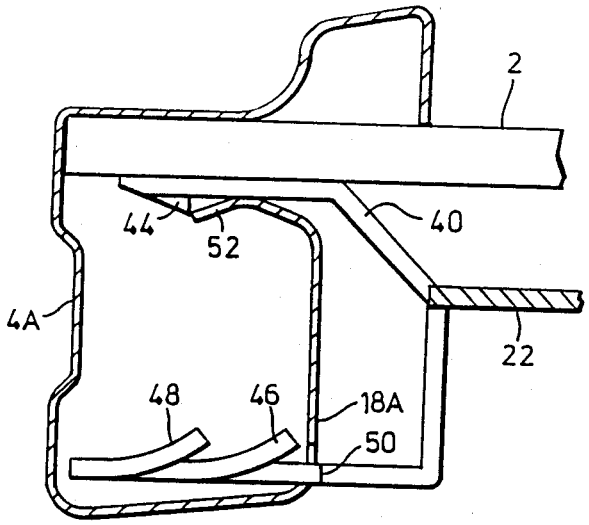
Figure 4:
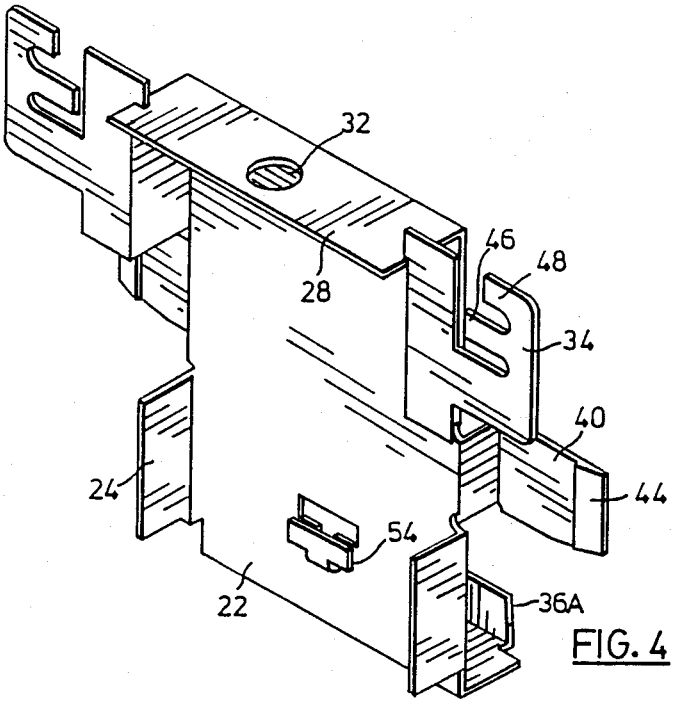

The tongues 34 are formed with two inwardly directed barbs 46 and 48, which are bent forwardly out of the general plane of the tongue so as to snap forwards as they are pressed through a slot 22. With the stile shown in FIG. 1, the lateral dimension of the arm 16 of the stile is only such as to permit the barbs 48 to pass fully into the interior of the arm, whilst the free end of the tongue 46 remains projecting from the slot. The same bracket may however be employed with stiles of an alternative well known section, as shown in FIG. 3. This stile 4A is of G-section, as shown and described in U.S. Pat. No. 3,750,337, and in this case the internal width of the stile is sufficient to accommodate the barb 46, as well as permitting the barb 44 to engage an inner edge 52 of the stile. An abutment 50 on the tongue 34 engages the surface 18A of the stile 4A, thus further stabilizing the assembly. When interacting with a stile 4, such abutment is provided by the outer end of the tongue 34.

Where guide rollers are utilized at the bottom of a door, a bracket defining a somewhat wider channel may be desirable, as shown in FIG. 4. In this case two spaced tongues 36 and 36*a* may be provided, engaging both of slots 24 and 26 (See FIG. 1). In this bracket, a hole 30 as shown in FIG. 2 may be used or it may be replaced by a T-shaped bracket 54 struck out of the front wall, and functioning as described in the Downes U.S. Pat. No. 4,391,019, by means of which bracket the arm can be releasably engaged in the channel. This enables the door to be assembled before the arms are fitted, which assists in transporting preassembled doors, and provides various other advantages as discussed in the Downes patent. This embodiment of bracket otherwise resembles that previously described.

In use, a door is assembled by fitting rails and stiles to the top, bottom and side edges of a panel. Each corner connector bracket is then fitted by engaging the tongue 36 with a slot 24 near the end of a rail, and swinging the connector towards the stile so that one land 40 passes between the back of the panel and the stile, and that tongue 34 on the same side as the land enters a slot 22 near the end of the stile until the barb 44 and the appropriate one of the barbs 46 and 48 lock into engagement with the stile. If the arms are already secured to the brackets by rivets through the holes 30, assembly is then complete, otherwise the arms must be fitted to the brackets 54 prior to installation of the door.

I claim:

1. A corner connector bracket for connecting a rail and a stile at the corner of a panel of a sliding door, the rail and stile each having channels to engage the panel, comprising a body defining a generally channel shaped, vertically extending and rearwardly facing recess having a forward wall and side walls, means for locating in the recess a vertically extending arm having a guide element supported at a distal end thereof, a first land at one vertical end of said front wall, said land being engageable with said rail at a rear side thereof, a first forwardly extending flange at said one vertical end of said forward wall, a distal end of the flange being inturned to form a first tongue extending vertically towards the other end of the body, said first tongue being engageable in a slot formed in a horizontal surface of said rail and forwardly of the channel therein, second flanges extending forwardly from each side of said forward wall at locations spaced from said one vertical end, distal ends of said second flanges being out-turned to form second lands engageable with the rear surface of the panel, and barbed second tongues extending laterally outwards from said side walls at locations thereon spaced from said one vertical end and to the rear of said second flanges, one of said tongues being lockable into a slot defined in the stile.

2. A corner connector according to claim 1, wherein each second land is formed with a barb on its rear surface engageable within the channel of the stile.

3. A corner connector according to claim 1, wherein the second tongues have plural barbs at different lateral spacings for engagement within stiles of different section.

4. A corner connector according to claim 1, wherein each side wall is provided with abutment surfaces engageable with a stile adjacent thereto when the land of the second flange on that side is within the channel of the stile.

5. A corner connector according to claim 1, 2 or 3, wherein the means for locating the vertically extending arm comprises an abutment flange for engaging an adjustment screw of the arm and the front wall defines a hole for receiving a rivet engaged in a slot defined by the arm.

6. A corner connector according to claim 1, 2 or 3, wherein the means for locating the vertically extending arm comprises an abutment flange for engaging an adjustment screw of the arm, and a T-bar extending rearwardly from the front wall of the channel for releasable engagement in a slot defined by the arm.

7. A sliding door, comprising a panel, top and bottom rails having channels engaging top and bottom edges of the panel, left and right stiles having channels engaging left and right edges of the panel and abutting opposite ends of the rails, and corner connector brackets connecting the stiles and rails at their points of abutment, each corner connector bracket comprising a body defining a generally channel shaped vertically extending and rearwardly facing recess having a forward wall and side walls, means for locating in the recess a vertically extending arm having a guide element supported at a distal end thereof, a first land at one vertical end of said front wall, said land being engaged with said rail at a rear side thereof, a first forwardly extending flange at said one vertical end of said forward wall, a distal end of the flange being inturned to form a tongue extending vertically towards the other end of the body, said first tongue being engaged in a slot formed in a horizontal surface of said rail and forwardly of the channel therein, second flanges extending forwardly from each side of said forward wall at locations spaced from said one vertical end, distal ends of said second flanges being out-turned to form second lands engaged with the rear surface of the panel, and barbed second tongues extending laterally outwards from said side walls at locations thereon spaced from said one vertical end and to the rear of said second flanges, one of said tongues being locked into a slot defined in the stile.

8. A door according to claim 7 wherein, in each corner connector, each second land is formed with a barb on its rear surface engaged within the associated stile.

9. A door according to claim 7 wherein, in each corner connector, the second tongues have plural barbs at different lateral spacings, at least one being received within the associated stile according to the cross-section of the latter.

10. A door according to claim 7, 8 or 9 wherein, in each corner connector, the means for locating the vertically extending arm comprises an abutment flange for engaging an adjustment screw of the arm and the front wall defines a hole for receiving a rivet engaged in a slot defined by the arm.

11. A door according to claim 7, 8 or 9 wherein, in each corner connector, the means for locating the vertically extending arm comprises an abutment flange for engaging an adjustment screw of the arm, and a T-bar extending rearwardly from the front wall of the channel for releasable engagement in a slot defined by the arm.

* * * * *